US010471502B2

(12) United States Patent
Kim et al.

(10) Patent No.: US 10,471,502 B2
(45) Date of Patent: Nov. 12, 2019

(54) CONTINUOUS CASTING AND ROLLING APPARATUS AND METHOD

(71) Applicant: POSCO, Pohang-si, Gyeongsangbuk-do (KR)

(72) Inventors: Seong-Yeon Kim, Gwangyang-si (KR); Young-Ju Ko, Gwangyang-si (KR); Il-Sin Bae, Gwangyang-si (KR); Choong-Yun Lee, Gwangyang-si (KR); In-Jae Lee, Gwangyang-si (KR); Jea-Sook Chung, Gwangyang-si (KR); Sang-Hyeon Lee, Gwangyang-si (KR)

(73) Assignee: POSCO, Pohang-si, Gyeongsangbuk-Do (KR)

( * ) Notice: Subject to any disclaimer, the term of this patent is extended or adjusted under 35 U.S.C. 154(b) by 539 days.

(21) Appl. No.: 15/107,903

(22) PCT Filed: Dec. 2, 2014

(86) PCT No.: PCT/KR2014/011661
§ 371 (c)(1),
(2) Date: Jun. 23, 2016

(87) PCT Pub. No.: WO2015/099307
PCT Pub. Date: Jul. 2, 2015

(65) Prior Publication Data

US 2016/0318096 A1 Nov. 3, 2016

(30) Foreign Application Priority Data

Dec. 26, 2013 (KR) ..... 10-2013-0163873

(51) Int. Cl.
*B22D 11/04* (2006.01)
*B22D 11/12* (2006.01)
(Continued)

(52) U.S. Cl.
CPC ..... *B22D 11/043* (2013.01); *B21B 1/463* (2013.01); *B21B 1/466* (2013.01);
(Continued)

(58) Field of Classification Search
CPC . B22D 11/043; B22D 11/126; B22D 11/1206; B22D 11/142; B21B 2015/0014;
(Continued)

(56) References Cited

U.S. PATENT DOCUMENTS 5,307,864 A 5/1994 Arvedi et al.
5,339,887 A 8/1994 Flemming et al.
(Continued)

FOREIGN PATENT DOCUMENTS

CN 1071868 A 5/1993
CN 1151912 A 6/1997
(Continued)

OTHER PUBLICATIONS

Jong Woo You; Batch and Endless Rolling System and Method; EPO English Machine Translation; Jul. 8, 2013; pp. 1-6.*
(Continued)

*Primary Examiner* — Bayan Salone
(74) *Attorney, Agent, or Firm* — Morgan, Lewis & Bockius LLP

(57) ABSTRACT

A continuous casting and rolling apparatus according to one embodiment of the present invention provides: a continuous caster for generating a steel sheet; a first rolling unit associated with the continuous caster; and a second rolling unit which is spaced apart in the outlet of the first rolling unit and comprises: a rolling mill for pressing down the steel sheet; and a cutter for cutting a portion of the steel sheet, wherein the cutter is spaced from the second rolling unit by a length corresponding to the length of the steel sheet discharged in an at least discontinuous rolling mode, and may comprise a
(Continued)

cut withdrawal unit provided between the first rolling unit and the second rolling unit. In addition, a continuous casting and rolling method according to another embodiment of the present invention is a continuous casting and rolling method in which a continuous rolling mode and a discontinuous rolling mode are switched to and from each other, and may comprise: a continuous casting step for generating a steel sheet; a rolling step for pressing down the steel sheet to a rolling mill after the continuous casting step; and a cutting step for cutting the steel sheet between the continuous casting step and the rolling step in a discontinuous rolling mode, and cutting the steel sheet with a cutter provided by being spaced apart from the rolling mill at an interval corresponding to the length of the steel sheet being cut and discharged in an at least discontinuous rolling mode.

6 Claims, 4 Drawing Sheets

(51) Int. Cl.

| | |
|---|---|
| ***B22D 11/14*** | (2006.01) |
| ***B21B 1/46*** | (2006.01) |
| ***B22D 11/043*** | (2006.01) |
| ***B22D 11/126*** | (2006.01) |
| *B21B 15/00* | (2006.01) |

(52) U.S. Cl.
CPC ..... *B22D 11/1206* (2013.01); *B22D 11/126* (2013.01); *B22D 11/142* (2013.01); *B21B 2015/0014* (2013.01); *Y10T 29/4998* (2015.01); *Y10T 29/49984* (2015.01); *Y10T 29/49989* (2015.01); *Y10T 29/49991* (2015.01)

(58) Field of Classification Search
CPC ..... B21B 1/463; B21B 1/466; Y10T 29/4998; Y10T 29/49984; Y10T 29/49989; Y10T 29/49991
See application file for complete search history.

(56) References Cited

U.S. PATENT DOCUMENTS

| | | | | |
|---|---|---|---|---|
| 5,400,850 | A | 3/1995 | Flemming et al. | |
| 5,461,770 | A | 10/1995 | Kimura et al. | |
| 5,511,606 | A * | 4/1996 | Streubel | B22D 11/1206 164/476 |
| 5,802,902 | A | 9/1998 | Rosenthal et al. | |
| 6,463,777 | B1 * | 10/2002 | de Curraize | B21B 1/28 72/203 |
| 6,527,882 | B1 * | 3/2003 | Wehage | B21B 1/26 148/541 |
| 8,365,806 | B2 | 2/2013 | Rosenthal et al. | |
| 9,352,368 | B2 * | 5/2016 | Colombo | B21B 1/463 |
| 2010/0275667 | A1 * | 11/2010 | Seidel | B21B 1/46 72/127 |

FOREIGN PATENT DOCUMENTS

| | | | | |
|---|---|---|---|---|
| CN | 101848776 | A | 9/2010 | |
| EP | 2554281 | A1 * | 2/2013 | B21B 1/18 |
| JP | H06-320203 | A | 11/1994 | |
| KR | 10-1990-0701437 | B1 | 12/1990 | |
| KR | 10-2008-0044897 | A | 5/2008 | |
| KR | 10-2010-0034768 | A | 4/2010 | |
| KR | 10-2010-0078425 | A | 7/2010 | |
| KR | 10-2013-0075799 | A | 7/2013 | |
| KR | 20130075799 | A * | 7/2013 | |
| RU | 2163855 | C2 | 3/2001 | |
| RU | 2004136029 | A | 6/2006 | |
| RU | 2413584 | C1 | 3/2011 | |
| WO | 99/04915 | A1 | 2/1999 | |

OTHER PUBLICATIONS

Office Action in corresponding Russian Patent Application No. 2016130321, dated Aug. 24, 2017 (With full English translation).
International Search Report and Written Opinion issued in corresponding International Patent Application No. PCT/KR2014/011661, dated Feb. 16, 2015; with partial English translation.
Korean Office Action dated Dec. 14, 2016 issued in Korean Patent Application No. 10-2016-7018983 (English translation).
Chinese Office Action dated Jan. 17, 2017 issued in Chinese Patent Application No. 201480071116.2.

* cited by examiner

【Figure 1】
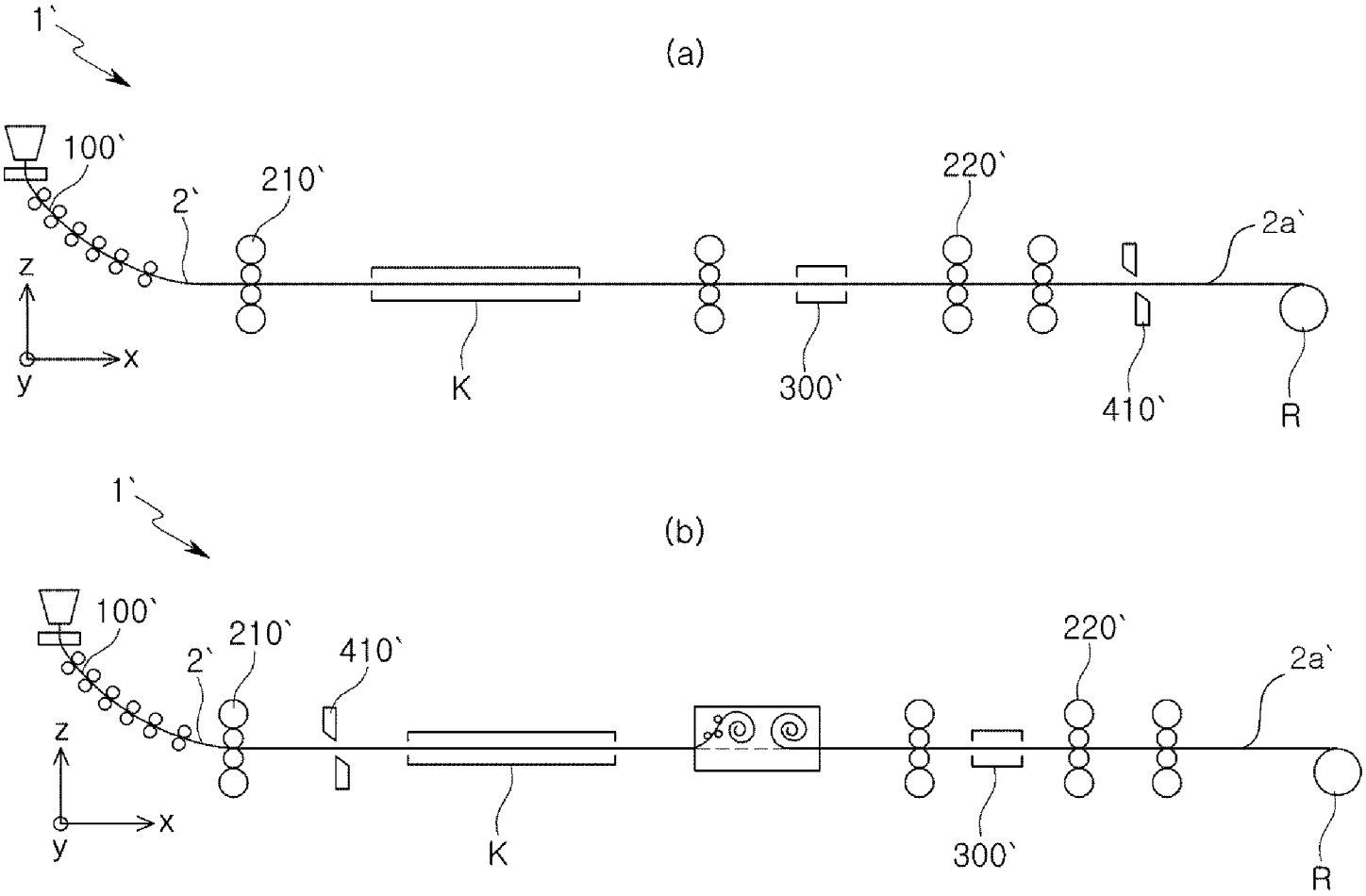

【Figure 2】
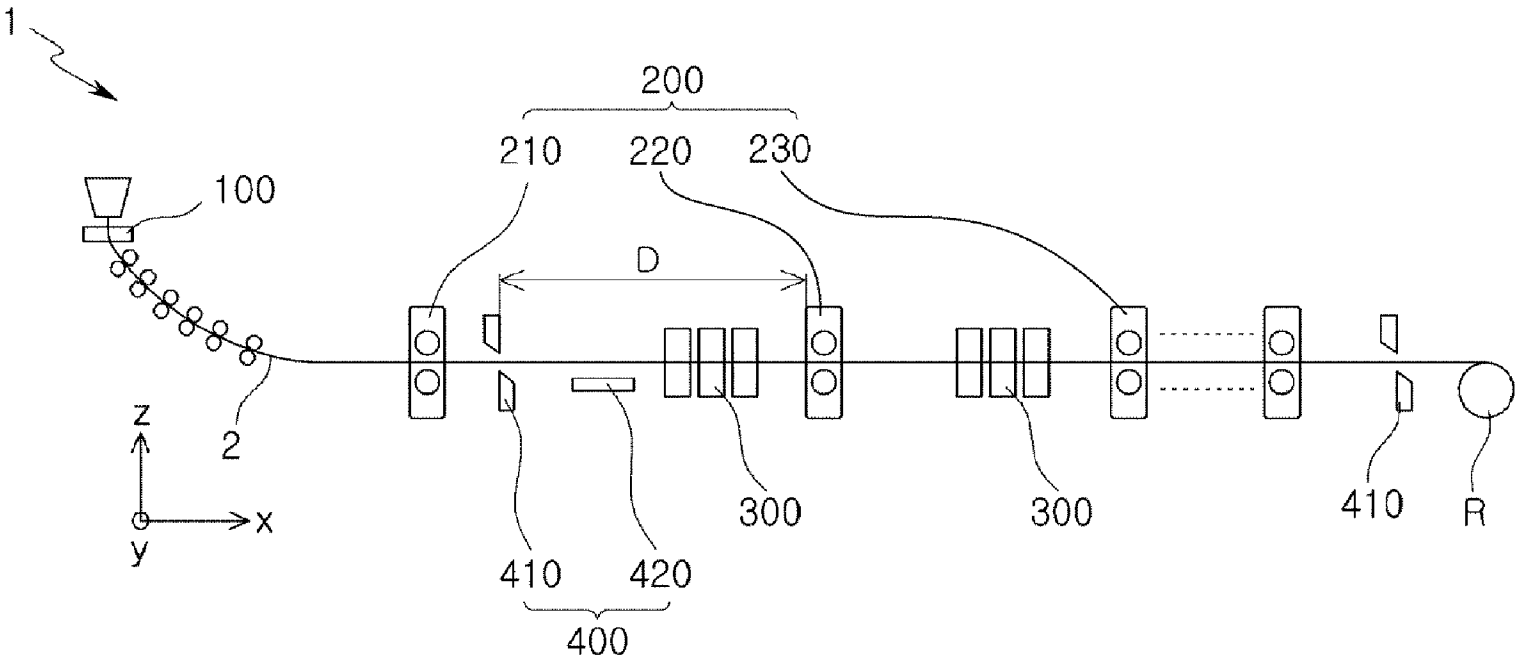

【Figure 3】
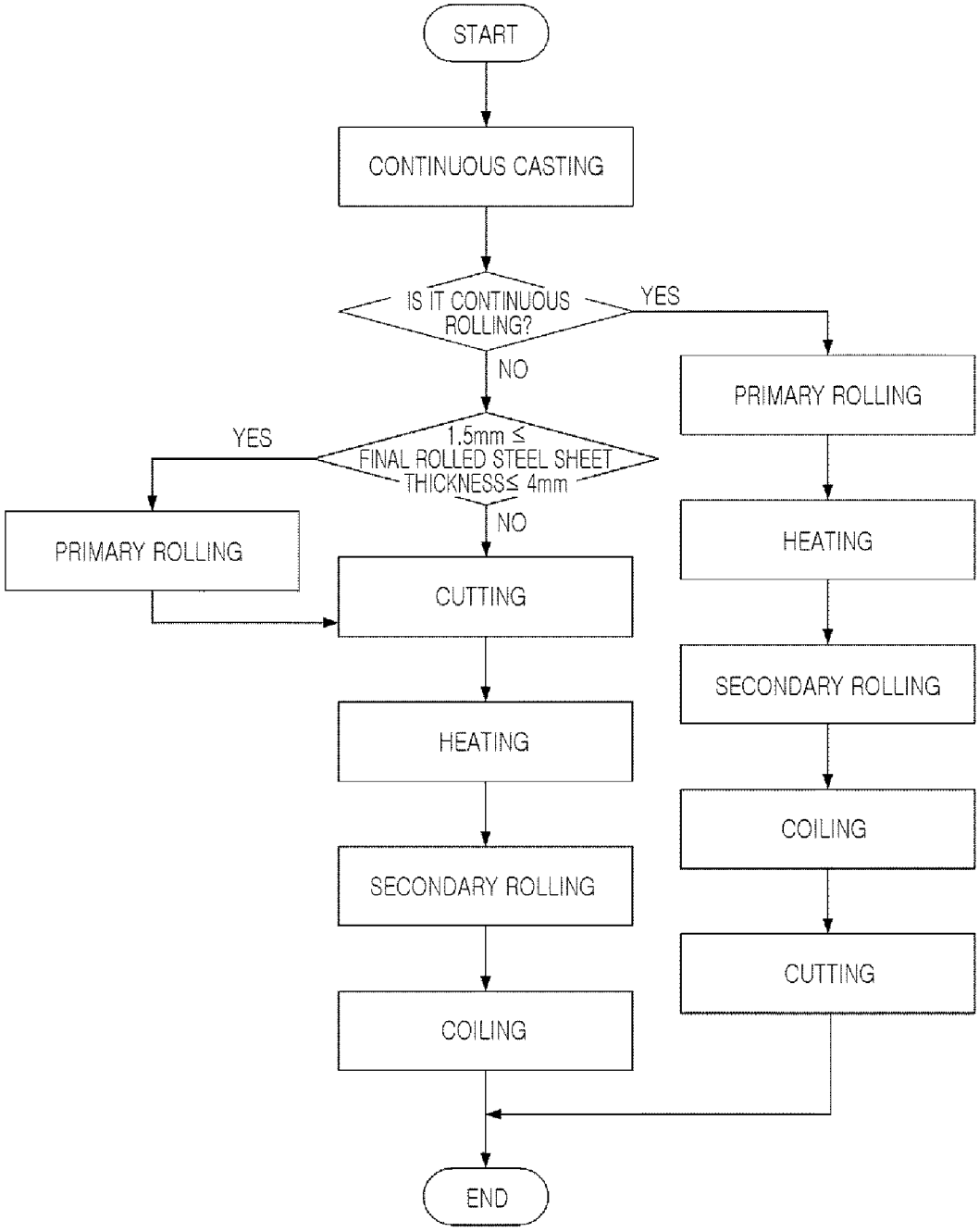

【Figure 4】
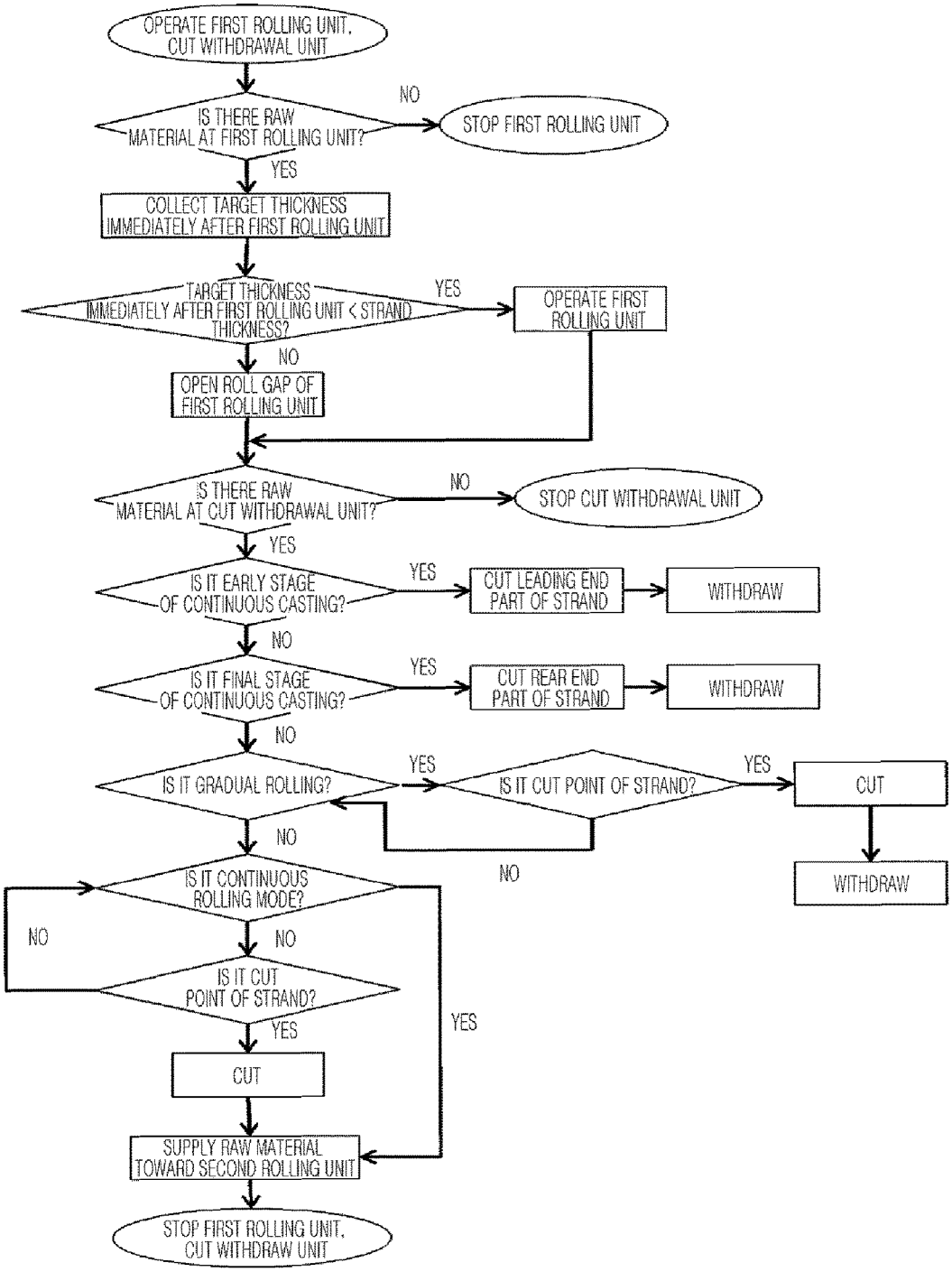

CONTINUOUS CASTING AND ROLLING APPARATUS AND METHOD

RELATED APPLICATIONS

This application is the U.S. National Phase under 35 U.S.C. § 371 of International Patent Application No. PCT/KR2014/011661, filed on Dec. 2, 2014, which in turn claims the benefit of Korean Application No. 10-2013-0163873, filed on Dec. 26, 2013, the disclosures of which Applications are incorporated by reference herein.

TECHNICAL FIELD

The present disclosure relates to a continuous casting and rolling apparatus and method, and more particularly, to a technique for preventing wastage of a strand or steel sheet during switching from a discontinuous rolling mode to a continuous rolling mode.

BACKGROUND ART

In a minimill process, a strand solidified in a continuous caster is rolled using the high temperature of the strand. Since such minimill processes incurs relatively low equipment costs and operating costs, as compared to conventional processes, minimill processes are now widely used.

In addition to such continuous casting and rolling processes, a discontinuous rolling process may be performed independently of the continuous casting process. This technique is disclosed in Korean Patent Application Laid-open Publication No. 1990-7001437.

That is, as illustrated in FIGS. 1A and 1B, a rolling process may be continuously performed, together with a continuous casting process, or a rolling process may be discontinuously performed together with a continuous casting process in a discontinuous rolling mode.

FIG. 1A illustrates equipment 1' for a continuous rolling process. Referring to FIG. 1A, a strand 2' having a constant thickness is produced by a continuous caster 100', and the strand 2' is primarily rolled by a first rolling unit 210'. Thereafter, while maintaining the temperature of the strand 2' using an insulator K, the strand 2' is transferred to a heater 300' and heated to a final rolling temperature, and then finally rolled by a second rolling unit 220' to produce a steel sheet 2*a*'. After the final rolling, the steel sheet 2*a*' is cut by a cutting machine 410' and wound around a rewinder R. In this manner, a rolled steel sheet 2*a*' may be produced.

FIG. 1B illustrates equipment 1' for a discontinuous rolling process. Referring to FIG. 1B, a strand 2' having a constant thickness is produced by a continuous caster 100', and the strand 2' is primarily rolled by a first rolling unit 210'. Thereafter, the strand 2' is cut using a cutting machine 410' before the strand 2' is transferred to a second rolling unit 220'. Therefore, a rolling process may be performed independently of the rate of casting of the continuous caster 100.

A slab cut from the strand 2' is wound around an intermediate coiler, and then the slab is transferred to a second rolling unit 220' after being heated to a rolling temperature by a heater 300'. The second rolling unit 220' rolls the slab to produce a rolled steel sheet 2*a*', and a rewinder R winds the rolled steel sheet 2*a'*.

Even when a steel sheet 2*a*', wound around the intermediate coiler, is unwound and transferred to the second rolling unit 220' during switching from the discontinuous rolling process to a continuous rolling process, the continuous caster 100' continuously produces a steel sheet 2*a*'. Thus, a portion of the steel sheet 2*a*' is inevitably cut and discarded.

To address this problem, research into continuous casting and rolling apparatuses and methods is needed.

DISCLOSURE

Technical Problem

An aspect of the present disclosure may provide a continuous casting and rolling apparatus and method allowing for switching between a continuous rolling mode and a discontinuous rolling mode while preventing wastage of a strand produced by a continuous caster during switching from the discontinuous rolling mode to the continuous rolling mode.

Technical Solution

According to an aspect of the present disclosure, a continuous casting and rolling apparatus may include: a continuous caster configured to produce a strand; a rolling mill configured to produce a rolled steel sheet by rolling the strand, the rolling mill including a first rolling unit connected to the continuous caster and a second rolling unit spaced apart from an exit side of the first rolling unit; and a cut withdrawal unit including a cutting machine configured to cut the strand, the cutting machine being disposed between the first and second rolling units and spaced apart from the second rolling unit by a distance at least equal to a length of the strand required for final production and discharging the rolled steel sheet.

The cutting machine may be spaced apart from the second rolling unit by a distance satisfying the following formula: $SL+6<D<2\times SL+12$ where SL refers to the length of the strand, D refers to the distance between the cutting machine and the second rolling unit, and SL and D are in meters (m).

The cut withdrawal unit may further include a withdrawing machine disposed between the cutting machine and the second rolling unit to remove a cut portion of the steel sheet.

The rolling mill may further include a third rolling unit disposed at an exit side of the second rolling unit, and the continuous casting and rolling apparatus may further include a heater disposed at an entrance side of the second rolling unit and a heater disposed between the second rolling unit and the third rolling unit.

According to another aspect of the present disclosure, a continuous casting and rolling method allowing for switching between a continuous rolling mode and a discontinuous rolling mode may include: producing a strand by continuous casting; after producing the strand by continuous casting, rolling the strand using a rolling mill to produce a rolled steel sheet; and cutting the strand in the discontinuous rolling mode before finishing the rolling of the strand, wherein the cutting of the steel sheet is performed using a cutting machine spaced apart from a second rolling unit by a distance at least equal to a cut length of the strand in the discontinuous rolling mode.

The rolling of the strand may include: after the producing of the strand by continuous casting, primarily rolling the strand to produce a first rolled steel sheet, the primary rolling being performed in the continuous rolling mode; and receiving and secondarily rolling the strand or the first rolled steel sheet to produce a second rolled steel sheet, the secondary rolling being performed in the continuous rolling mode and the discontinuous rolling mode.

The primary rolling may also be performed in the discontinuous rolling mode to obtain a final rolled steel sheet thickness of 1.5 mm to 4 mm.

Advantageous Effects

According to the continuous casting and rolling apparatus and method of the present disclosure, a strand or steel sheet is not partially discarded during switching from a discontinuous rolling mode to a continuous rolling mode Therefore, the yield of a continuous casting and rolling process may be improved.

DESCRIPTION OF DRAWINGS

FIGS. 1A and 1B are views illustrating continuous casting and rolling apparatuses of the related art.

FIG. 2 is a process view of a continuous casting and rolling apparatus according to an exemplary embodiment of the present disclosure.

FIGS. 3 and 4 are flowcharts illustrating a continuous casting and rolling method according to an exemplary embodiment of the present disclosure.

BEST MODE

Exemplary embodiments of the present disclosure will now be described in detail with reference to the accompanying drawings. The disclosure may, however, be exemplified in many different forms and should not be construed as being limited to the specific embodiments set forth herein. Rather, these embodiments are provided so that the disclosure will be thorough and complete, and will fully convey the scope of the present invention to those skilled in the art.

In the drawings, the shapes and dimensions of elements may be exaggerated for clarity, and the same reference numerals will be used throughout to designate the same or like elements.

The present disclosure relates a continuous casting and rolling apparatus and method designed to secure a space having at least a length SL corresponding to a length of a strand 2 required for producing a final rolled steel sheet 2*a* and thus to prevent the loss of the strand 2 or the rolled steel sheet 2*a* during switching from a discontinuous rolling mode to a continuous rolling mode That is, according to the continuous casting and rolling apparatus and method of the present disclosure, a second rolling unit 220 and a cut withdrawal unit 400 may be spaced apart from each other by at least a length SL corresponding to a length of a strand 2 required for producing and discharging a final rolled steel sheet 2*a*, and thus, during switching from a discontinuous rolling mode to a continuous rolling mode, some of the strand 2 or the rolled steel sheet 2*a* may not be discarded. Therefore, the productivity of a continuous rolling process may be improved.

In detail, FIG. 2 is a process view of a continuous casting and rolling apparatus 1 according to an exemplary embodiment of the present disclosure. Referring to FIG. 2, the continuous casting and rolling apparatus 1 of the exemplary embodiment may include: a continuous caster 100 configured to produce a strand 2; a rolling mill 200 including a first rolling unit 210 associated with the continuous caster 100 and a second rolling unit 220 spaced apart from an exit side of the first rolling unit 210, the rolling mill 200 being configured to produce a rolled steel sheet 2*a* by rolling the strand 2; and a cut withdrawal unit 400 including a cutting machine 410 configured to cut the strand 2, the cutting machine 410 being disposed between the first rolling unit 210 and the second rolling unit 220 and spaced apart from the second rolling unit 220 by at least a length SL corresponding to a length of the strand 2 required for final production and discharging the rolled steel sheet 2*a*.

In the continuous casting and rolling apparatus 1 of the exemplary embodiment, the cutting machine 410 may be spaced apart from the second rolling unit 220 by a distance D satisfying the formula: $SL+6<D<2SL+12$. In the formula, SL refers to a length corresponding to a length of a strand 2 required for producing and discharging a final rolled steel sheet 2*a*, D refers to the distance between the cutting machine 410 and the second rolling unit 220, and SL and D are in meters (m).

Furthermore, according to the exemplary embodiment, the cut withdrawal unit 400 of the continuous casting and rolling apparatus 1 may further include a withdrawing machine 420 disposed between the cutting machine 410 and the second rolling unit 220 to remove a cut steel sheet 2*a*.

Furthermore, according to the exemplary embodiment, the rolling mill 200 of the continuous casting and rolling apparatus 1 may further include a third rolling unit 230 disposed at an exit side of the second rolling unit 220, and the continuous casting and rolling apparatus 1 may further include a heater 300 disposed at an entrance side of the second rolling unit 220 and a heater 300 disposed between the second rolling unit 220 and the third rolling unit 230.

The continuous caster 100 may produce a strand 2 through a casting process. That is, in the continuous caster 100, molten steel may be supplied from a tundish to a mold in which the molten steel may be cooled and formed into a strand 2, and the strand 2 may be guided by guide rolls to the rolling mill 200 (described later).

Since the continuous caster 100 produces a strand 2 depending on the solidification rate of molten steel, it is difficult to adjust the production rate of the strand 2. Therefore, if the strand 2 produced by the continuous caster 100 is continuously fed into the rolling mill 200 to produce a rolled steel sheet 2*a* by rolling the strand 2, the production rate of the rolled steel sheet 2*a* may be limited.

On the other hand, if the strand 2 produced by the continuous caster 100 is discontinuously fed into the rolling mill 200 for producing a rolled steel sheet 2*a*, the rolling mill 200 may perform a rolling process at a high production rate to produce a rolled steel sheet 2*a* independently of the production rate of the continuous caster 100.

That is, a rolling process for producing a rolled steel sheet 2*a* using the rolling mill 200 from a strand 2 produced by the continuous caster 100 may be performed in a continuous rolling mode or a discontinuous rolling mode. For example, the rolling process may be performed while switching between such rolling modes.

The rolling mill 200 may receive a strand 2 produced by the continuous caster 100 and may produce a rolled steel sheet 2*a* by rolling the strand 2. To this end, the rolling mill 200 may roll the strand 2 or the steel sheet 2*a* while passing the strand 2 or the steel sheet 2*a* between a pair of rolling rolls. For example, the rolling mill 200 may include a plurality of rolling roll pairs.

In addition, the rolling mill 200 may include the first rolling unit 210 and the second rolling unit 220 disposed at different positions.

The first rolling unit 210 of the rolling mill 200 may be connected to a rear end (exit side) of the continuous caster 100 and may produce a rolled steel sheet 2*a* in cooperation with the second rolling unit 220 in the continuous rolling mode. The first rolling unit 210 may include a stand having a pair of rolling rolls.

That is, in the continuous rolling mode, since a strand 2 is rolled in a state in which the strand 2 is connected to the continuous caster 100, the continuous caster 100 may be negatively affected if rolling starts suddenly. Thus, the first rolling unit 210 may produce a first rolled steel sheet 2*a* having a certain thickness, and then the second rolling unit 220 may finally produce a second rolled steel sheet 2*a*.

Therefore, the first rolling unit 210 may only be used in the continuous rolling mode, and in the discontinuous rolling mode, the second rolling unit 220 may only be used to produce a rolled steel sheet 2*a* by rolling a strand 2.

Particularly, when a rolling process switches from the discontinuous rolling mode to the continuous rolling mode, the first rolling unit 210 performs gradual rolling. That is, in the discontinuous rolling mode, a strand 2 is cut and supplied to the second rolling unit 220, and the cut strand 2 is rolled by the second rolling unit 220. However, in the continuous rolling mode, a strand 2 is not cut but is continuously supplied to the second rolling unit 220 in a state in which the strand 2 is engaged with the first rolling unit 210, and as the second rolling unit 220 engages with the strand 2, rolling is started and continued.

When the rolling process switches from the discontinuous rolling mode to the continuous rolling mode, the thickness of a steel sheet 2*a* passing through the first rolling unit 210 may be varied. That is, in the discontinuous rolling mode, the thickness of a steel sheet 2*a* passing through the first rolling unit 210 may be equal to the thickness of a strand 2 or smaller than the thickness of the strand 2 due to rolling by the first rolling unit 210.

After the strand 2 is finally cut in the discontinuous rolling mode, the strand 2 may have a transitional thickness region due to rolling by the first rolling unit 210. In general, the transitional thickness region of the strand 2 is cut into predetermined lengths and withdrawn by the cut withdrawal unit 400. Then, if the thickness of the strand 2 reaches a value proper for the continuous rolling mode, the strand 2 is not cut and is supplied to the second rolling unit 220.

At the moment when the strand 2 or steel sheet 2*a* is engaged with the second rolling unit 220, the first rolling unit 210 holds the strand 2 or steel sheet 2*a*, and thus the strand 2 or steel sheet 2*a* may not be moved back to the continuous caster 100 and may be stably rolled in the continuous rolling mode.

The second rolling unit 220 may directly receive a first rolled steel sheet 2*a* from the first rolling unit 210 or a strand 2 from the continuous caster 100 and may finally produce a second rolled steel sheet 2*a*. The second rolling unit 220 rolls a strand 2 using rolling rolls to produce a rolled steel sheet 2*a*, and the rolled steel sheet 2*a* is discharged after being coiled by a rewinder R. The second rolling unit 220 may include at least one stand having a pair of rolling rolls.

To this end, the second rolling unit 220 may be connected to a rear end (exit side) of the first rolling unit 210, and the cut withdrawal unit 400 may be disposed between the second rolling unit 220 and the first rolling unit 210.

Particularly, the second rolling unit 220 may be spaced apart from the cutting machine 410 of the cut withdrawal unit 400 by at least a length SL corresponding to a length of a strand 2 required for producing a rolled steel sheet 2*a* to be coiled and discharged as a coil. In this manner, a space for placing a finally rolled steel sheet 2*a* may be provided, and the second rolling unit 220 may be operated independently of the first rolling unit 210.

In addition to the cutting machine 410, the heater 300 (described later) may be disposed between the first rolling unit 210 and the second rolling unit 220, and the length SL between the cutting machine 410 and the second rolling unit 220 may be adjusted by considering an installation length of the cutting machine 410 and the heater 300.

That is, the distance D between the cutting machine 410 and the second rolling unit 220 may be set by considering a length SL of a strand 2 required for producing a final rolled steel sheet 2*a* to be coiled and discharged as a coil and an installation length for the cutting machine 410 and the heater 300.

In general, the installation length for the cutting machine 410 and the heater 300 may be 6 m.

In addition, the distance D between the cutting machine 410 and the second rolling unit 220 may be set to be as short as possible so as to prevent thermal loss in a strand 2. Thus, only the upper limit of the distance D may be set.

For example, since an auxiliary space is necessary for other operations and repairing operations, the upper limit of the distance D between the cutting machine 410 and the second rolling unit 220 may be set to be twice the length SL required for producing a final rolled steel sheet 2*a*. In addition to this, an auxiliary space for installing the first rolling unit 210 and the heater 300 may be considered.

In other words, the distance D between the cutting machine 410 and the second rolling unit 220 may be at least equal to or greater than the sum of the length SL of a strand 2 required for producing a final rolled steel sheet 2*a* and the installation length for the cutting machine 410 and the heater 300. For example, the distance D may be equal to or shorter than twice the sum of the length SL and the installation length.

This may be expressed by the formula: $SL+6<D<2SL+12$. In the formula, SL refers to a length corresponding to a length of a strand 2 necessary for producing and discharging a final rolled steel sheet 2*a*, D refers to the distance between the cutting machine 410 and the second rolling unit 220, and SL and D are in meters (m).

The distance D may be varied according to the length of a strand 2 produced by the continuous caster 100. That is, if the thickness of a strand 2 increases, a relatively short length of a strand 2 is necessary for producing a final coil 2*a*, and thus an absolute length required to accommodate a piece of the strand 2 is varied.

Owing to such a space, during switching from the discontinuous rolling mode to the continuous rolling mode, a strand 2 or rolled steel sheet 2*a* may not be discarded except for a length of the strand 2 or rolled steel sheet 2*a* necessary for thickness adjustment.

That is, owing to a space corresponding to the distance D, during switching from the discontinuous rolling mode to the continuous rolling mode, a raw material may not be discharged except for a length of the raw material necessary for thickness adjustment.

In addition, since a length of a strand 2 corresponding to a final coil is placed in a space having a length corresponding to the length SL of the strand 2 in the discontinuous rolling mode, the second rolling unit 220 may roll the strand 2 or rolled steel sheet 2*a* independently of the first rolling unit 210.

That is, according to the related art, in the discontinuous rolling mode, an intermediate coiler disposed next to the first rolling unit 210 receives a first rolled steel sheet 2*a* and provides the first rolled steel sheet 2*a* to the second rolling unit 220 for second rolling.

In this case, when the process begins to switch from the discontinuous rolling mode to the continuous rolling mode, the second rolling unit 220 secondarily rolls a steel sheet 2*a* unwound from the intermediate coiler while the continuous caster 100 continuously produces a strand 2. Thus, a part of the strand 2 produced during this period can not be transferred to the intermediate coiler or the second rolling unit 220, and thus the part of the strand 2 is cut and discarded.

However, according to the exemplary embodiment of the present disclosure, instead of using an intermediate coiler, a space corresponding to a length SL of a strand 2 produced in the discontinuous rolling mode is provided between the cutting machine 410 and the second rolling unit 220, and thus, during switching from the discontinuous rolling mode to the continuous rolling mode, some of a steel sheet 2*a* may not be discarded, thereby preventing waste.

In addition, since the heater 300 (described later) is disposed at the entrance side of the second rolling unit 220, a strand 2 or steel sheet 2*a* may be heated before rolling.

Furthermore, the rolling mill 200 may further include the third rolling unit 230 at the exit side of the second rolling unit 220, and thus a steel sheet 2*a* rolled by the second rolling unit 220 may be further rolled to a thinner thickness by using the third rolling unit 230. The third rolling unit 230 may include at least two stands, each including a pair of rolling rolls.

If the period during which a steel sheet 2*a* is rolled by the second rolling unit 220 is long, the steel sheet 2*a* may be cooled to a temperature not suitable for rolling. For this case, another heater 300 may be disposed between the second rolling unit 220 and the third rolling unit 230.

Furthermore, in the continuous rolling mode or the discontinuous rolling mode, if the thickness of a steel sheet 2*a* rolled by the second rolling unit 220 is insufficient, the steel sheet 2*a* may be further rolled using the third rolling unit 230.

As described above, the continuous casting and rolling apparatus 1 of the exemplary embodiment includes the heater 300 between the first rolling unit 210 and the second rolling unit 220, and if the temperature of a steel sheet 2*a* is insufficiently high when the first rolling unit 210 or the second rolling unit 220 is operated, the steel sheet 2*a* may be heated using the heater 300.

In addition, when the third rolling unit 230 is further provided, another heater 300 may be disposed between the second rolling unit 220 and the third rolling unit 230.

In addition, the heaters 300 may include insulators for maintaining the temperature of a steel sheet 2*a* for a longer time. For example, the insulators may surround at least one side of a strand 2 or steel sheet 2*a* so as to maintain the temperature of the strand 2 or steel sheet 2*a*.

The insulators may be arranged entirely around a strand 2 or steel sheet 2*a* for efficient insulation, and insulation gas may be supplied to the insulators for more efficient insulation.

The insulators may be formed of refractory bricks including a ceramic material. The insulators may be provided in the form of holding furnaces.

The cut withdrawal unit 400 may cut a strand 2 or steel sheet 2*a* or withdraw the strand 2 or steel sheet 2*a*. To this end, the cut withdrawal unit 400 may include the cutting machine 410 and the withdrawing machine 420.

A plurality of cutting machines 410 may be provided in a region between the first rolling unit 210 and the second rolling unit 220 and a region beside the exit side of the second rolling unit 220.

Particularly, the cutting machine 410 may be spaced apart from the second rolling unit 220 by a distance equal to at least a length SL of a strand 2 required for producing and discharging a final rolled steel sheet 2*a*. In this case, a strand 2 produced by the continuous caster 100 may not be wasted as described above.

The withdrawing machine 420 may discharge a defective strand 2 or steel sheet 2*a*. That is, the withdrawing machine 420 disposed between the first rolling unit 210 and the second rolling unit 220 may remove defective steel sheets from first steel sheets 2*a* produced by the first rolling unit 210.

In other words, the withdrawing machine 420 may remove a defective strand 2 produced by the continuous caster 100 at an early stage of continuous casting or a defective steel sheet 2*a* having an uneven thickness produced when the first rolling unit 210 performs gradual rolling during switching from the discontinuous rolling mode to the continuous rolling mode.

In addition, the cut withdrawal unit 400 may include another cutting machine 410 at the exit side of the second rolling unit 220 so as to cut a steel sheet 2*a* to be coiled in the continuous rolling mode.

FIGS. 3 and 4 are flowcharts illustrating a continuous casting and rolling method according to an exemplary embodiment of the present disclosure. FIG. 4 is a flowchart illustrating the continuous casting and rolling method in a continuous rolling mode, and FIG. 5 is a flowchart illustrating how the first rolling unit 210 and the cut withdrawal unit 400 are operated in the continuous rolling mode and a discontinuous rolling mode. Switching between the discontinuous rolling mode and the continuous rolling mode is possible by varying operations of the first rolling unit 210 and the cut withdrawal unit 400.

Referring to FIGS. 3 and 4, according to the exemplary embodiment of the present disclosure, the continuous casting and rolling method may be performed while switching between the continuous rolling mode and the discontinuous rolling mode. The continuous casting and rolling method may include: a continuous casting process to produce a strand 2; a process of rolling the strand 2 using the rolling mill 200 after the continuous casting process, so as to produce a rolled steel sheet 2*a*; and a process of cutting the strand 2 in the discontinuous rolling mode before the rolling process is finished, the cutting process being performed using the cutting machine 410 spaced apart from the second rolling unit 220 by at least a length SL corresponding to a cut length of the strand 2.

According to the exemplary embodiment, after the continuous casting process, the rolling process of the continuous casting and rolling method may include a primary rolling process to produce a first rolled steel sheet 2*a* by rolling the strand 2 in the continuous rolling mode; and a secondary rolling process to produce a second rolled steel sheet 2*a* from the strand 2 or the first rolled steel sheet 2*a* in the continuous rolling mode and the discontinuous rolling mode.

In the continuous casting and rolling method of the exemplary embodiment, the primary rolling process may be also performed in the discontinuous rolling mode to obtain a final rolled steel sheet 2*a* having a thickness of 1.5 mm to 4 mm.

In the continuous casting process, the strand 2 is produced by the continuous caster 100. That is, the continuous caster 100 continuously receives molten steel and produces the strand 2. At an early stage of the continuous casting process, the strand 2 is produced in a state not satisfying required conditions, and thus an early length of the strand 2 may be cut and discarded using the cut withdrawal unit 400 connected to an exit side of the continuous caster 100.

In the rolling process, the strand 2 produced in the continuous casting process is received and rolled to produce a rolled steel sheet 2*a*.

The rolling process may be performed in the continuous rolling mode so as to produce a rolled steel sheet 2*a* by continuously receiving the strand 2 produced in the continuous casting process. In the continuous rolling mode, the rolling process may be performed through the primary rolling process and the secondary rolling process. In this case, the continuous caster 100 may be less affected by the rolling process.

That is, the primary rolling process may be performed to obtain a primarily rolled steel sheet 2*a* having a certain thickness before a final thickness, and the secondary rolling process may be performed after the primary rolling process so as to finally obtain a secondarily rolled steel sheet 2*a* by rolling the primarily rolled steel sheet 2*a*.

The primary rolling process may not be performed in the discontinuous rolling mode. That is, the primary rolling process may only be performed in the continuous rolling mode.

However, this is a non-limiting example. For example, in the discontinuous rolling mode, if the thickness of a rolled steel sheet 2*a* finally produced through the secondary rolling process is insufficiently, the primary rolling process may be performed as a preliminary rolling process.

In detail, even in the discontinuous rolling mode, if it is required to produce a rolled steel sheet 2*a* having a final thickness of 1.5 mm to 4 mm, the primary rolling process may be performed to preliminarily roll a strand 2 produced by the continuous caster 100.

The primary rolling process may be performed after the continuous casting process, and the secondary rolling process may be performed after the primary rolling process. In addition, so as to produce a rolled steel sheet 2*a* having improved qualities, a heating process may be performed between the continuous casting process and the primary rolling process, and another heating process may be performed between the primary rolling process and the secondary rolling process.

Because the heating process between the primary rolling process and the secondary rolling process provides additional heating, the heating process may be referred to as an additional heating process.

If a defective strand 2 not satisfying required conditions is produced at an early stage of the continuous casting process, a first cutting/withdrawing process may be performed to remove the defective strand 2. The first cutting/withdrawing process may be performed after determining whether the continuous casting process is at its early stage or not.

In the first cutting/withdrawing process, the cutting machine 410 disposed at the exit side of the first rolling unit 210 may be operated to cut out a defective leading end part of the strand 2 produced by the continuous caster 100, and the defective leading end part of the strand 2 may be discharged to the outside by the withdrawing machine 420.

As described above, the continuous casting and rolling method of the exemplary embodiment may further include a heating process so as to produce a steel sheet 2*a* having improved qualities by heating a strand 2 and then transferring the strand 2 to the rolling mill 200.

If the heating process is performed before the rolling process, a rolled steel sheet 2*a* produced by rolling a strand 2 may have improved qualities. That is, if the heating process is performed between the primary rolling process, the secondary rolling process, and a gradual rolling process (described later) of the rolling process, a rolled steel sheet 2*a* having improved qualities may be produced.

According to the exemplary embodiment, the continuous casting and rolling method may be performed while switching between the continuous rolling mode and the discontinuous rolling mode. In this case, although the continuous caster 100 is not affected during switching from the continuous rolling mode to the discontinuous rolling mode, the continuous caster 100 may be affected during switching from the discontinuous rolling mode to the continuous rolling mode. Thus, a particular process may be performed.

In detail, while a strand 2 is continuously produced by the continuous caster 100, if the strand 2 is suddenly rolled by the rolling mill 200, the moving speed of the strand 2 at the continuous caster 100 may be suddenly decreased, or the strand 2 may be moved backwards because of a reduction of the thickness of the strand 2 in the rolling mill 200. In this case, the surface of molten steel may suddenly rise.

To prevent such a sudden rise of the surface of molten steel, the rolling process may include a gradual rolling process. That is, rolling may be performed while gradually reducing a gap between the rolling rolls of the first rolling unit 210, so as to prevent the continuous caster 100 from being impacted.

However, due to the gradual rolling process, a steel sheet 2*a* having a thickness transition region in which the thickness of the rolled steel sheet 2*a* is gradually reduced may be produced. Since the thickness transition region of the steel sheet 2*a* may cause a decrease in the quality of the steel sheet 2*a* when the steel sheet 2*a* is rolled by the second rolling unit 220. The thickness transition region may be cut and removed from the steel sheet 2*a*.

To this end, a second cutting/withdrawing process may be performed after the gradual rolling process. In the second cutting/withdrawing process, a defective region of a steel sheet 2*a* produced by the first rolling unit 210 may be cut out using the cutting machine 410, and the cut defective region may be discharged to the outside using the withdrawing machine 420. Thus, the quality of the steel sheet 2*a* may be improved.

In addition, since a rolled steel sheet 2*a* not having a defective region is produced as described above, after the rolled steel sheet 2*a* is wound into a coil, the whole coil may not be discarded because of a partial defective region of the rolled steel sheet 2*a*.

The invention claimed is:

1. A continuous casting and rolling apparatus comprising:

a continuous caster configured to produce a strand;

a rolling mill configured to produce a rolled steel sheet by rolling the strand, the rolling mill comprising a first rolling unit connected to the continuous caster and a second rolling unit spaced apart from an exit side of the first rolling unit; and a cut withdrawal unit comprising a cutting machine configured to cut the strand, wherein the cutting machine is disposed between the first and second rolling units and spaced apart from the second rolling unit by a distance at least equal to a length of the strand required for final production, wherein the cut withdrawal unit further comprises a withdrawing machine disposed between the cutting machine and the second rolling unit, the cut withdrawal unit being configured to remove a cut portion of the rolled steel sheet, wherein the first rolling unit is configured to perform gradual rolling when a rolling process switches from a discontinuous rolling mode to a continuous rolling mode, and wherein the withdrawing machine is arranged so as to withdraw a transitional thickness region formed by the gradual rolling of the first rolling unit, after the transitional thickness region is cut by the cutting machine.

2. The continuous casting and rolling apparatus of claim 1, wherein the cutting machine is spaced apart from the second rolling unit by a distance satisfying the following formula:

$$SL+6<D<2\times SL+12$$

where SL refers to the length of the strand, D refers to the distance between the cutting machine and the second rolling unit, and SL and D are in meters (m).

3. The continuous casting and rolling apparatus of claim 1, wherein the rolling mill further comprises a third rolling unit disposed at an exit side of the second rolling unit, and the continuous casting and rolling apparatus further comprises heaters disposed at an entrance side of the second rolling unit, and the third rolling unit.

4. A continuous casting and rolling method allowing for switching between a continuous rolling mode and a discontinuous rolling mode, the continuous casting and rolling method comprising:

producing a strand by continuous casting, using a continuous caster;

after producing the strand by continuous casting, rolling the strand using a rolling mill to produce a rolled steel sheet, the rolling mill comprising a first rolling unit connected to the continuous caster and a second rolling unit spaced apart from an exit side of the first rolling unit; and cutting the strand in the discontinuous rolling mode before finishing the rolling of the strand, wherein the cutting of the steel sheet is performed using a cutting machine spaced apart from a second rolling unit by a distance at least equal to a cut length of the strand in the discontinuous rolling mode, wherein the rolling the strand comprises:

performing gradual rolling by the first rolling unit when a rolling process switches from the discontinuous rolling mode to the continuous rolling mode;

after the gradual rolling, primarily rolling the strand in the continuous rolling mode to produce a first rolled steel sheet; and receiving and secondarily rolling the strand or the first rolled steel sheet to produce a second rolled steel sheet, the secondarily rolling being performed in the continuous rolling mode and the discontinuous rolling mode, wherein at a stage of a continuous casting process, the strand is cut and discarded, wherein the gradual rolling produces a thickness transition region in which a thickness of the rolled steel sheet is gradually reduced, and wherein the thickness transition region is cut and discarded.

5. The continuous casting and rolling method of claim 4, wherein the primary rolling is also performed in the discontinuous rolling mode to obtain a final rolled steel sheet thickness of 1.5 mm to 4 mm.

6. The continuous casting and rolling apparatus of claim 1, wherein rolling rolls of the first rolling unit are configured such that a gap between the rolling rolls is gradually reduced when the rolling process switches from the discontinuous rolling mode to the continuous rolling mode.

* * * * *